US007976024B1

(12) United States Patent
Stapleton

(10) Patent No.: US 7,976,024 B1
(45) Date of Patent: Jul. 12, 2011

(54) TESSELLATING PATTERN CUBES

(76) Inventor: Jonathan Walker Stapleton, Essex, VT (US)

( * ) Notice: Subject to any disclaimer, the term of this patent is extended or adjusted under 35 U.S.C. 154(b) by 182 days.

(21) Appl. No.: 12/319,931

(22) Filed: Jan. 14, 2009

Related U.S. Application Data

(60) Provisional application No. 61/011,032, filed on Jan. 14, 2008.

(51) Int. Cl.
*A63F 9/12* (2006.01)
*A63H 33/08* (2006.01)

(52) U.S. Cl. ..... 273/157 R; 273/156; 446/124

(58) Field of Classification Search ..... 273/156, 273/153 R, 157 R; 446/120, 124, 125
See application file for complete search history.

(56) References Cited

U.S. PATENT DOCUMENTS

| | | | | | |
|---|---|---|---|---|---|
| 2,493,435 | A * | 1/1950 | Arehambault | ..... | 446/124 |
| 3,655,201 | A * | 4/1972 | Nichols | ..... | 273/153 R |
| 3,788,645 | A * | 1/1974 | Nelson | ..... | 273/156 |
| 5,000,713 | A * | 3/1991 | Cheng | ..... | 446/120 |
| 5,098,328 | A * | 3/1992 | Beerens | ..... | 446/125 |
| 5,407,201 | A | 4/1995 | Whitehurst | | |
| D359,315 | S | 6/1995 | Tacey | | |
| 5,617,691 | A * | 4/1997 | Yamamoto | ..... | 446/125 |
| 6,086,444 | A * | 7/2000 | Glickman | ..... | 446/124 |
| 6,152,797 | A | 11/2000 | David | | |
| 6,196,544 | B1 | 3/2001 | Rachovsky | | |
| 6,439,571 | B1 * | 8/2002 | Wilson | ..... | 273/157 R |
| 2008/0280523 | A1 * | 11/2008 | Bishop | ..... | 446/124 |

* cited by examiner

*Primary Examiner* — Steven Wong

(57) ABSTRACT

A cube comprising a first set (18) of three identical, contiguous faces and a second set (19) of three identical, contiguous faces. The first set (18) has third order rotational symmetry about a common corner (20) and comprises a first face (22). The first face (22) comprises a male connector fin (36A), a female connector slot (38A), a first band (28A), and a second band (30A). The male connector fin (36A) and female connector slot (38A) lie parallel to, adjacent to, and on opposite sides of a diagonal (34) emanating from the common corner (20). The first band (28A) parallels the diagonal (34) and connects the midpoints of two edges of the first face (22). The second band (30A) mirrors the first band across the diagonal (34). The first set (18) and the second set (19) are enantiomers. Accordingly, a plurality of these cubes can be snapped together, face-to-face, to manifest a variety of tessellating band patterns.

9 Claims, 14 Drawing Sheets

TESSELLATING PATTERN CUBES

CROSS-REFERENCE TO RELATED APPLICATIONS

This application claims the benefit of provisional patent application Ser. No. 61/011,032, filed 2008 Jan. 14 by the present inventor.

FEDERALLY SPONSORED RESEARCH

Not Applicable

SEQUENCE LISTING OR PROGRAM

Not Applicable

BACKGROUND OF THE INVENTION

1. Field of the Invention

This invention relates to tessellating pattern blocks that can be linked to create a variety interesting surface patterns.

2. Prior Art—Two Dimensional Tessellations

A variety of two dimensional tessellating pattern puzzles are known. The simplest examples are traditional jigsaw puzzles, which feature irregularly shaped pieces with graphics. The puzzle pieces tessellate (fit together to fill space) and create continuous patterns when the pieces are correctly assembled. While these puzzles are enjoyable, they tend to stifle creativity; there is only one way to put them together. Concerning one particular edge of one particular puzzle piece, it can only properly abut to one other edge of one other puzzle piece.

Other known tessellating puzzles, whose pieces have more regular geometric shapes, offer more opportunities for creative expression. Although there is still generally one "solution," pieces of some of these puzzles can be assembled to tessellate in a variety of ways, each of which produces a continuous graphic pattern. However, these pieces with regular geometric shapes are most often still limited in the manner that they can abut with one another. For example, one edge often properly abuts to a fraction of all other edges. Furthermore, although they are interesting, these tessellation puzzles still cannot match the concrete "realness" of a three-dimensional building block. They literally lack a fundamental dimension. A two dimensional tessellation simply does not have the richness and complexity of three dimensional reality.

The reason that makers of two dimensional tessellation puzzles have not made three dimensional puzzles is simply that creating an three dimensional tessellation is very difficult.

Three Dimensional Tessellations

In fact, many common brick-shaped construction blocks do tessellate. Furthermore, they connect releasably. However, these blocks' tessellations are usually limited by the fact that each face can connect most often to one other face. Additionally, most often only two faces of these blocks can form any connection at all. Furthermore, these blocks do not have interesting surface patterns that form continuous patterns with adjacent blocks. If they did have surface patterns, those patterns would always connect to adjacent blocks in the same manner, due to the restrictive nature of their connections.

Some three dimensional tessellation puzzles with surface patterns are known. Whitehurst (U.S. Pat. No. 5,407,201—Apr. 19, 1995) describes a three-dimensional puzzle with individual pieces featuring overlapping "indicia." These indicia span the edges of juxtaposed pieces. However, since the juxtaposed pieces of Whitehurst's puzzle form only discrete images at their borders, no surprising and interesting patterns can emerge. One can, for example, juxtapose the left and right halves of a pig, but one is still stuck with pigs; it is not possible to arrange the puzzle so something new and unexpected appears. Another shortcoming of Whitehurst's puzzles is that the pieces have no means of connection. They must be supported by a special tray that helps the overall puzzle maintain structural integrity.

Rachovsky (U.S. Pat. No. 6,196,544—Mar. 6, 2001) describes a three-dimensional puzzle whose pieces can be used to create a variety of continuous patterns. Rachovsky's puzzle pieces are identically shaped "z-polycube" pieces featuring different surface patterns. When Rachovsky's puzzle pieces are juxtaposed, banded patterns emerge. By rearranging a plurality of puzzle pieces, one can create a variety of structures with a variety of surface patterns.

Although Rachovsky's puzzle does enable a player to create something new, it has several key disadvantages. First, Rachovsky's puzzle pieces do not securely connect to one another to produce structures with integrity; they must be stacked, nested, or nestled. Second, Rachovsky's puzzle is too difficult and unintuitive to be broadly appealing to the public. His z-shaped puzzle pieces are tricky to manipulate, and his blocks' non-identical surface patterns make play very challenging. A third disadvantage of Rachovsky's puzzle is that his individual puzzle pieces are not inviting in themselves. They are simply not fun looking.

Tessellating Polyhedra with "Six Face Symmetry"

Several U.S. Patents (U.S. Pat. No. 5,098,328, by Bierens—Mar. 24, 1992; U.S. Pat. No. 6,439,571, by Wilson—Aug. 27, 2002; and U.S. Pat. No. D359,315, by Tacey—Jun. 13, 1995) describe cube blocks with "six face symmetry." All of these cubes' faces are identical, allowing any face on one of these cubes to connect with any face on another identical block. Accordingly, these cubes are generally intended to be used as a set of identical blocks which connect together to build structures. These characteristics make these cubes much more intuitive and simpler to use than the "z-polycubes" described by Rachovsky. However, these prior art cubes with "six face symmetry", as well as other symmetric polyhedral blocks, have several salient disadvantages.

A first disadvantage of known construction polyhedra is that none of their designs can be easily manufactured using injection molding processes. All of them require the manufacture and assembly of many individual pieces. For example, Bierens' patent (referenced above) suggests a method by which his cubes might be manufactured as six separate pieces, which must then be assembled before use. Hollister describes a somewhat similar plan for a tetrahedral building block with symmetrical faces in his U.S. Pat. No. 6,152,797 (Nov. 28, 2000). Hollister's patent showed how his tetrahedron block might be manufactured as four separate triangular faces, plus four separate insertable connectors—eight pieces in all.

A second disadvantage of known "facially symmetric" polyhedra is that, when they are assembled, no new and interesting continuous surface patterns emerge. They are not a pattern puzzle so much as a structural medium. They lack the intriguing bands that are produced by Rachovsky's "z-polycubes," for example.

A third disadvantage of the known "facially symmetric" cubes is that their individual appearances are purely functional, not fun. They are geometric structures whose purpose is apparent, but who are not inviting or entertaining in and of themselves.

OBJECTS AND ADVANTAGES

Accordingly, my invention has several objects and advantages. A first object of my invention is to provide a puzzle piece that can tessellate in three dimensions. This ability to tessellate (i.e. fill space) means that my pattern cubes can be used to build a wide variety of open and closed structures, extending in any direction.

A second object of my invention is to provide a pattern cube, any face of which can connect to any face of an identical pattern cube. This ability to connect from any face, to any face, makes my pattern cubes easy to use. One does not have to search for a compatible face, because they are all compatible.

A third object of my invention is to provide a secure but releasable snap connection between mated cubes. This connection allows a plurality of my cubes to be assembled into a secure structure that can be lifted, moved, and displayed.

A fourth object of my invention is to provide pattern cubes with banded surface patterns that, upon connection of my cubes, form continuous banded patterns that extend across the borders between adjacent cubes. This ability ensures that every visible face of a connected cube will be part of an interesting and continuous band pattern. Thus there is essentially "no wrong answer" during play.

A fifth object of my invention is to provide pattern cubes that can produce either of two distinct types of cross-border patterns upon connection. Specifically, either linear or right-angle band patterns form across the borders between adjacent cubes. Which pattern emerges depends upon which cube faces are connected. This variation allows a "player" to control the types of patterns that emerge when connections are made, thus controlling the overall pattern of the structure that is being built. Someone building a "meta-cube" of eight individual pattern cubes could, for example, create a structure with either six or twelve continuous surface bands. In fact, one use of my pattern blocks is as a puzzle. The object of the puzzle is to build an eight cube structure that has one, two, three, four, five, six, seven, eight, nine, or twelve continuous bands. One, five, and twelve are very difficult. Four and six are easiest.

A sixth object of my invention is to provide a construction cube whose connectors resemble an adjacent nose and mouth. This resemblance allows an entire face of one of my cubes to be styled as a bandit's visage. When colored black, the two surface bands on each face resemble a bandit's mask. The additions of eyes peering through one of the bands, and dimples to accentuate the "smile," complete the bandit's visage. Every face of my pattern cubes appears to be an identical bandit, and my cubes connect as two bandits bite one another's nose. In this way, even a single one of my cubes is entertaining. The fact that they bite noses to connect makes them even more fun.

A seventh object of my invention is to provide a pattern block that is simple and economical to manufacture. Production quantities of my blocks have been successfully molded as two pieces of plastic, using a straight-pull injection mold. Their two plastic parts were quite easily assembled.

Further objects and advantages of my invention will become apparent from a consideration of the drawings and ensuing description.

SUMMARY

In accordance with the present invention my pattern cube comprises first and second sets of three contiguous faces. The first set of three contiguous faces has third order rotational symmetry about a common corner. Each face of this first set comprises two bands, each band beginning at the midpoint of an edge of the face that ends at the common corner, and each band paralleling a surface diagonal that emanates from the common corner of the face. Each face of this first set further comprises a male connector fin and a female connector slot, both adjacent to and paralleling the previously mentioned diagonal. The male connector fin and female connector slot are essentially 180 degree rotations of one another about the diagonal. The second set of three contiguous faces is an enantiomer of the first set.

DRAWINGS—FIGURES

REFERENCE NUMERALS

| | |
|---|---|
| 18 | first set of three faces |
| 19 | second set of three faces |
| 20 | common corner of first set |
| 21 | common corner of second set |
| 22-27 | cube faces |
| 28A-F | face bands with eyes |
| 30A-F | face bands without eyes |
| 32, 33 | edges of face 22 |
| 34 | "incorporeal" diagonal |
| 36A-F | male fins |
| 38A-F | female slots |
| 40A-F | lateral ridges |
| 42AR-FR | right eyes |
| 42AL-FL | left eyes |
| 44AR-FR | right dimples |
| 44AL-FL | left dimples |
| 46-51 | outer corners |
| 52, 54 | male fin base angles |
| 56L, 56R | left and right cheek hair patches |
| 58 | chin hair patch |
| 60 | forehead hair patch |
| 62L, 62R | left and right nostrils |
| 64L, 64R | left and right large teeth |
| 66 | tube |
| 68 | pin |

PREFERRED EMBODIMENT

FIGS. 1A-1H, 2C

Basic Symmetry

A preferred embodiment of my pattern cubes consists of two sets of contiguous, identical, square faces. Each set of faces has 3rd order rotational symmetry about a common corner, and each set is an enantiomer (mirror image, but non-identical) of the other set.

Figure 1A:
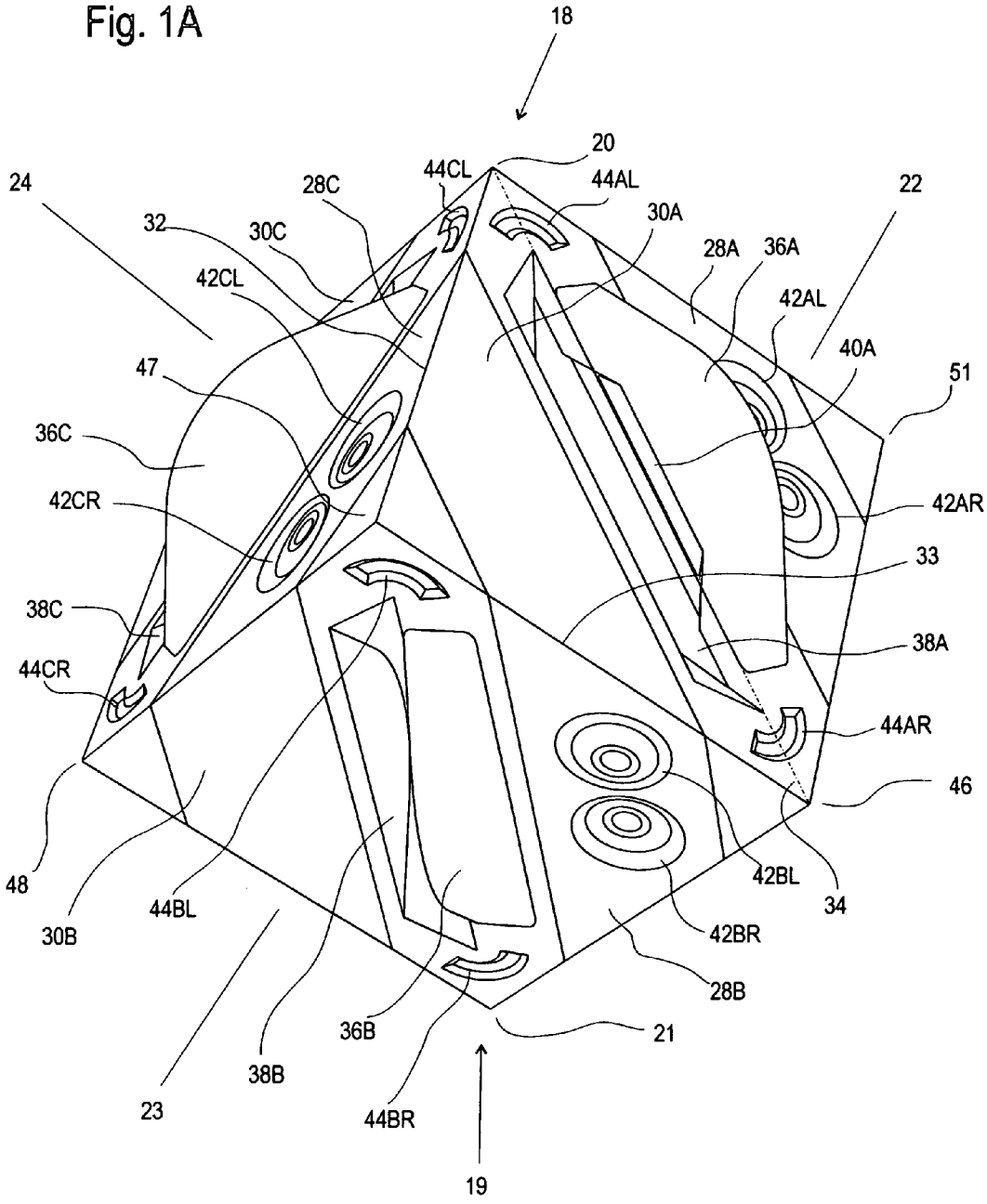
FIGS. 1A-1E show external views of my pattern cube.
Figure 1B:
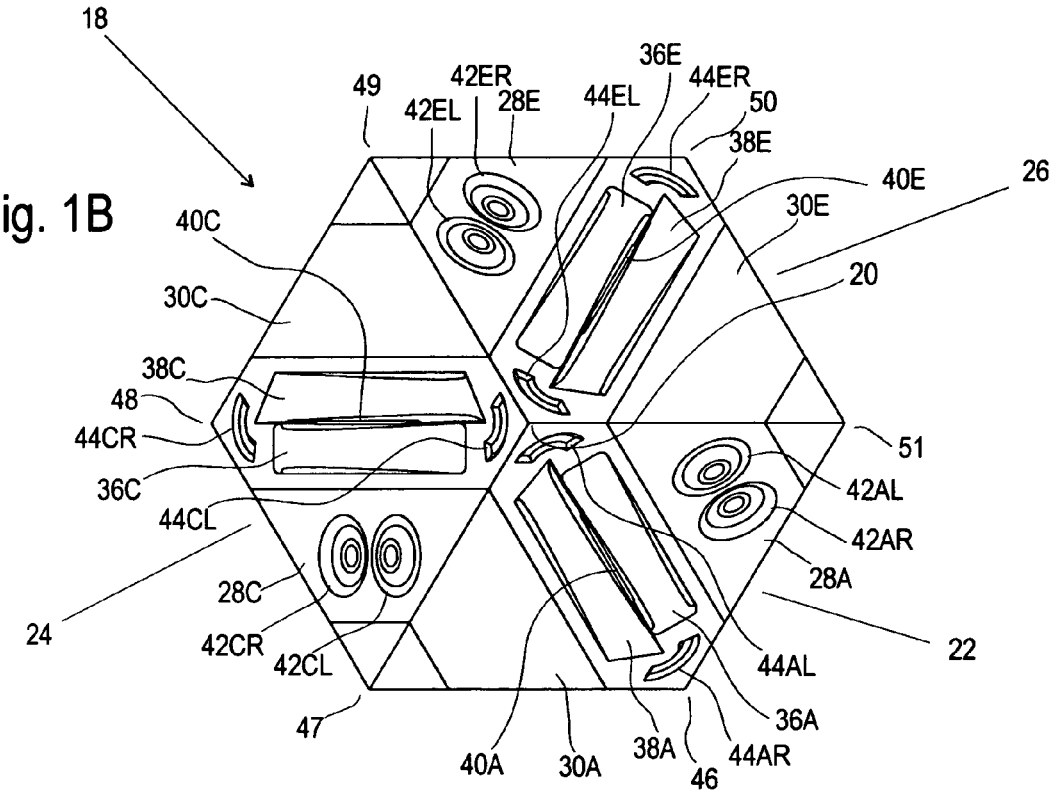
Figure 1C:
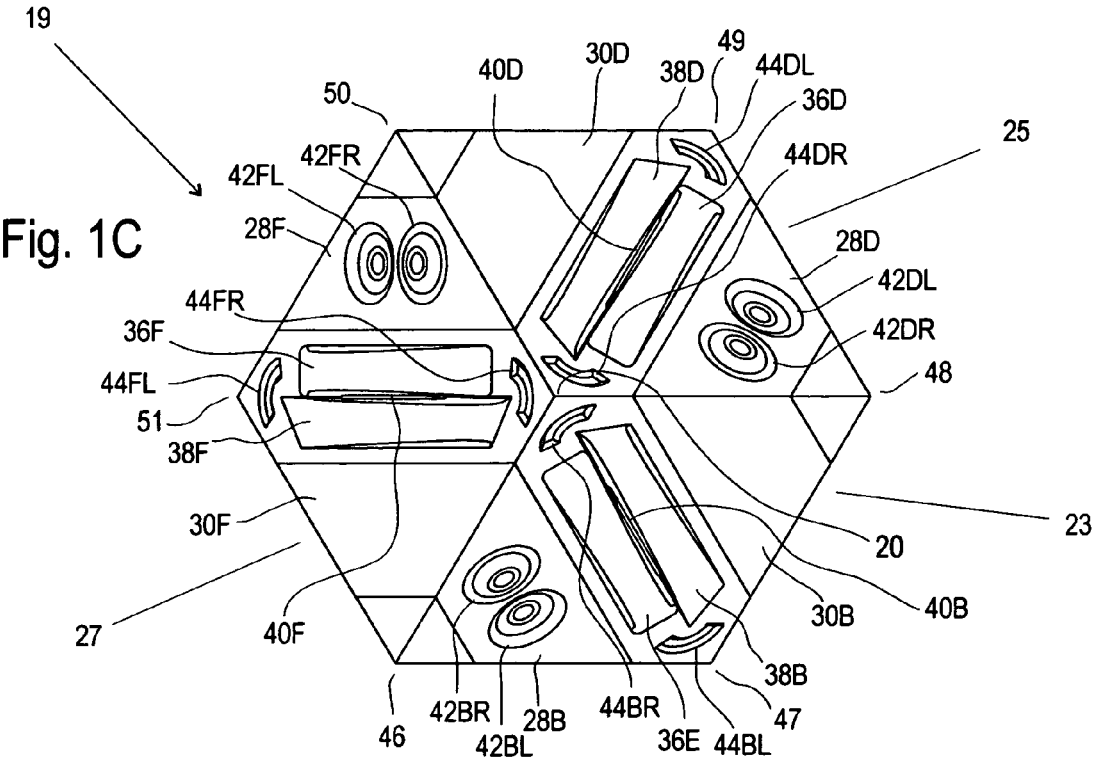

FIG. 1A (side perspective view), FIG. 1B (top view), and FIG. 1C (bottom view) show my preferred embodiment. FIG. 1B (top view) shows that my preferred embodiment has a first set 18 of three square and contiguous faces 22, 24, and 26. This set 18 of faces is centered about a common corner 20. FIG. 1C (bottom view) shows a second set 19 of three contiguous faces 23, 25, and 27. This second set 19 of faces is centered about a common corner 21. For reference, these figures also define outer corners 46, 47, 48, 49, 50, and 51.

FIGS. 1B (top view) and 1C (bottom view) also show that set 18, consisting of faces 22, 24, and 26, is a mirror image of set 19, but it is not identical to set 19. This relationship between set 18 and set 19 is known as "enantiomeric." Set 18 is an enantiomer of set 19, and vice versa.

Details of a Face

Due to the symmetry of my pattern cubes, a careful description of one cube face can be used to understand the entire cube. To that end, the features of face 22 will be described here in detail.

FIG. 1A (perspective view) provides a detailed view of the features of face 22. This figure shows an incorporeal diagonal 34, two bands 28A and 30A, a nose or male fin 36A, a mouth or female slot 38A, and edges 32 and 33. Diagonal 34 is not part of the invention, but it is shown here to facilitate explanation of the other features' placements. Diagonal 34 emanates from common corner 20, and extends across face 22 to outer corner 46.

[Note: since all faces on my pattern cubes are identical, identical features on different faces are indicated with the same number but different suffixes. For example, on face 22 there is male fin 36A, while on face 23 there is an identical male fin 36B.]

FIG. 1A shows that one end of band 30A is centered on the midpoint of edge 32, and the other end of band 30A is centered on the midpoint of edge 33. It can be seen that band 30A parallels diagonal 34. Band 28A is substantially a mirror image of band 30A, the mirror plane of this mirror symmetry lying perpendicular to an imaginary line segment connecting outer corners 47 and 51 and passing through common corner 20 and outer corner 46.

Although it is not apparent from the figures, in my preferred embodiment bands 30A and 28A are painted black.

FIG. 1A also shows that male fin 36A is situated parallel and adjacent to diagonal 34. Male fin 36A extends orthogonally outward from face 22.

FIG. 1A shows that the female slot 38A is situated parallel and adjacent to diagonal 34. Female slot 38A can be understood as an approximate inverse of the outer surface of male fin 36A.

Figure 1D:
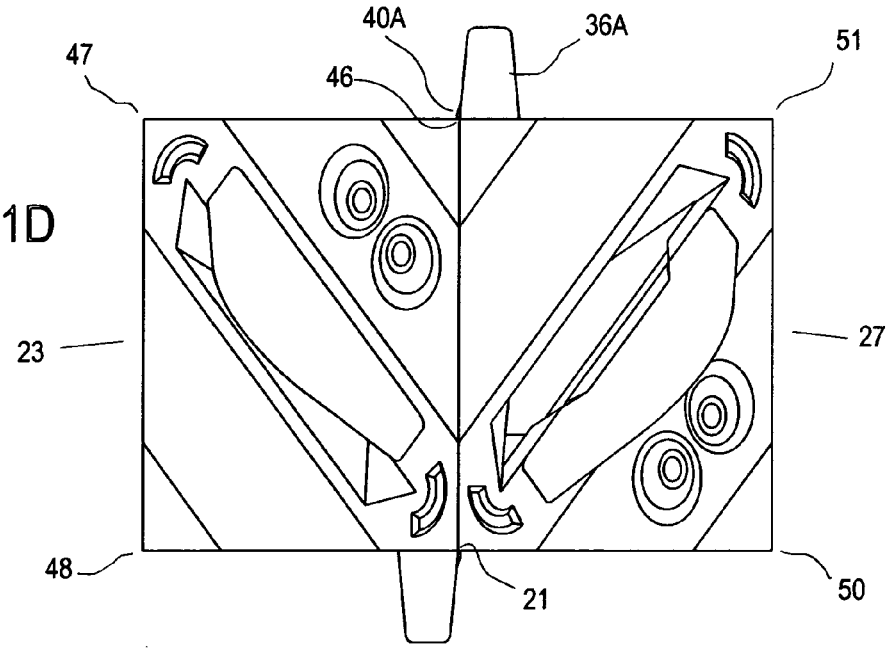
Figure 1E:
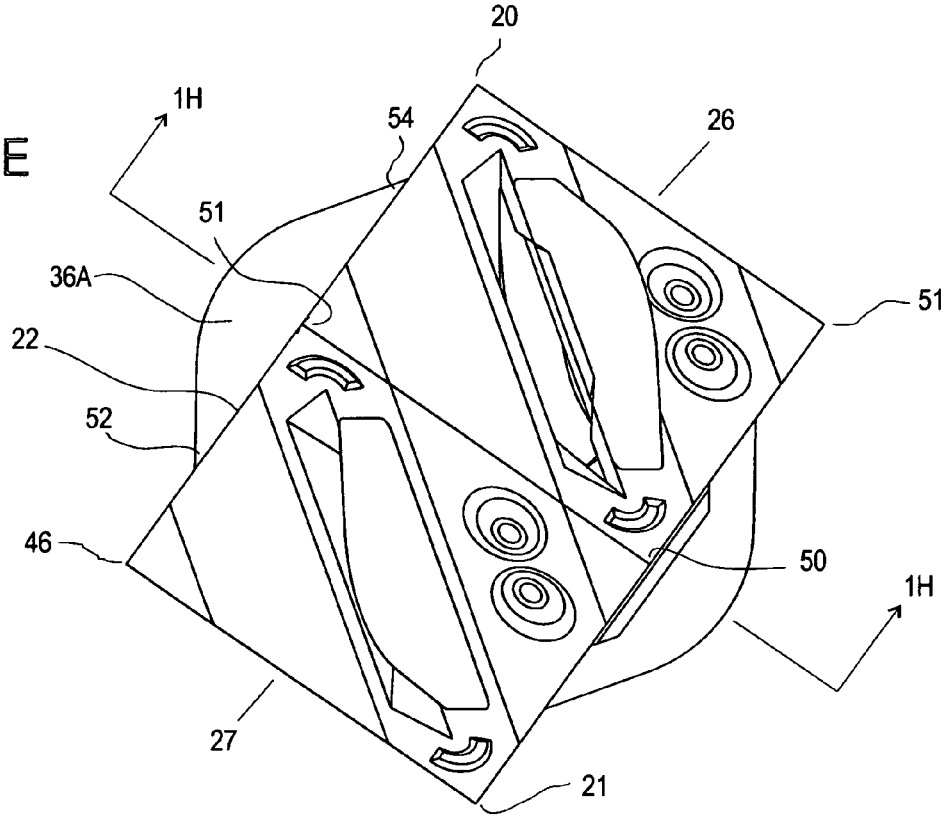
Figure 1F:
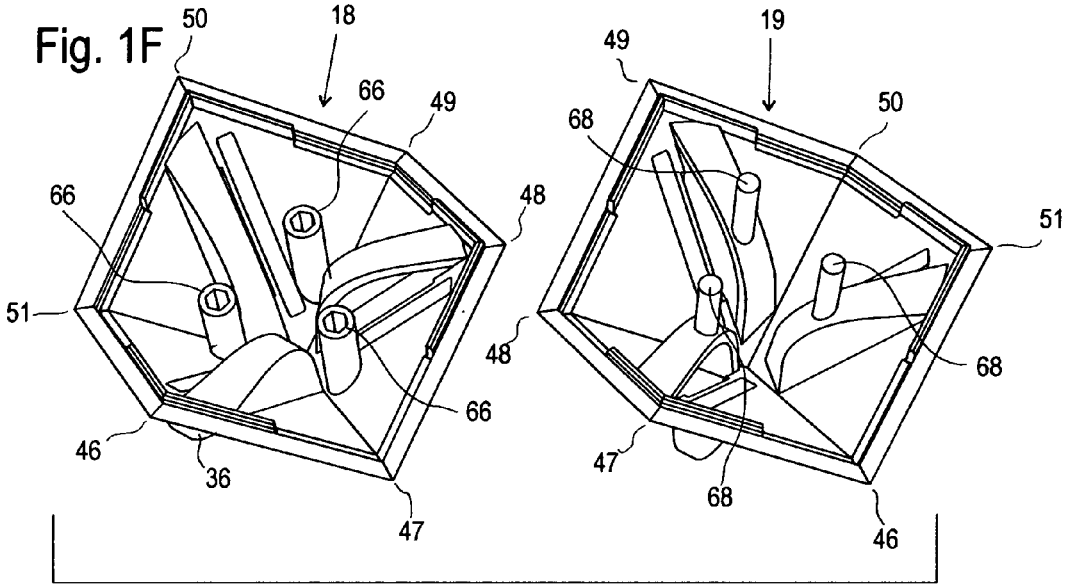
FIGS. 1F and 1G show the internal components of my pattern cube.
Figure 1G:
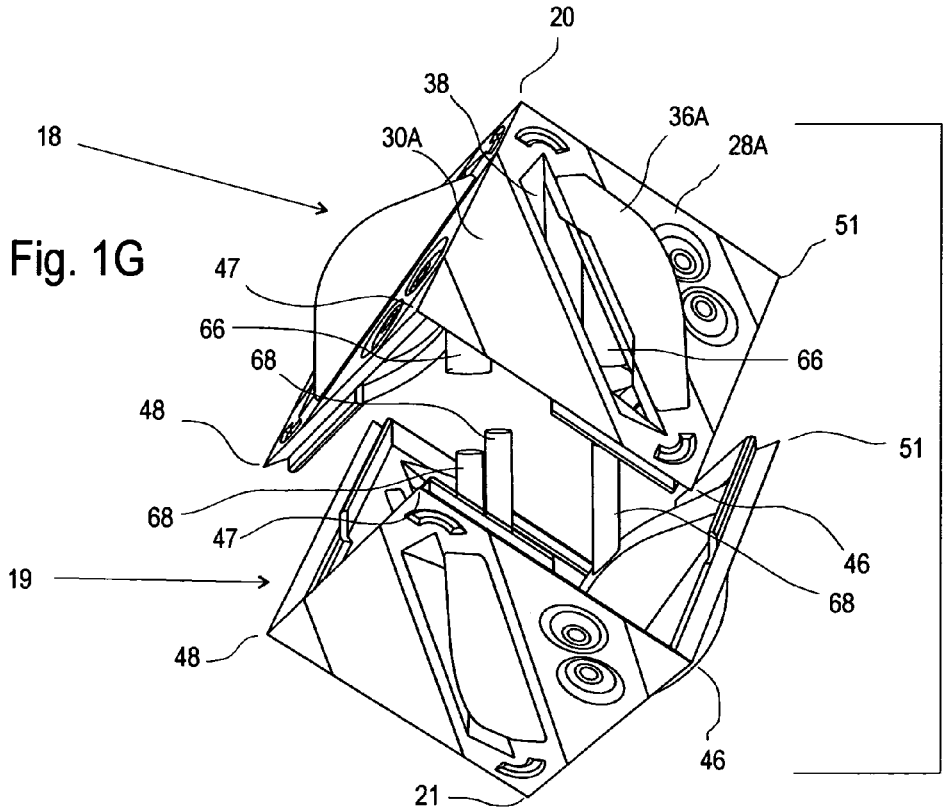
Figure 1H:
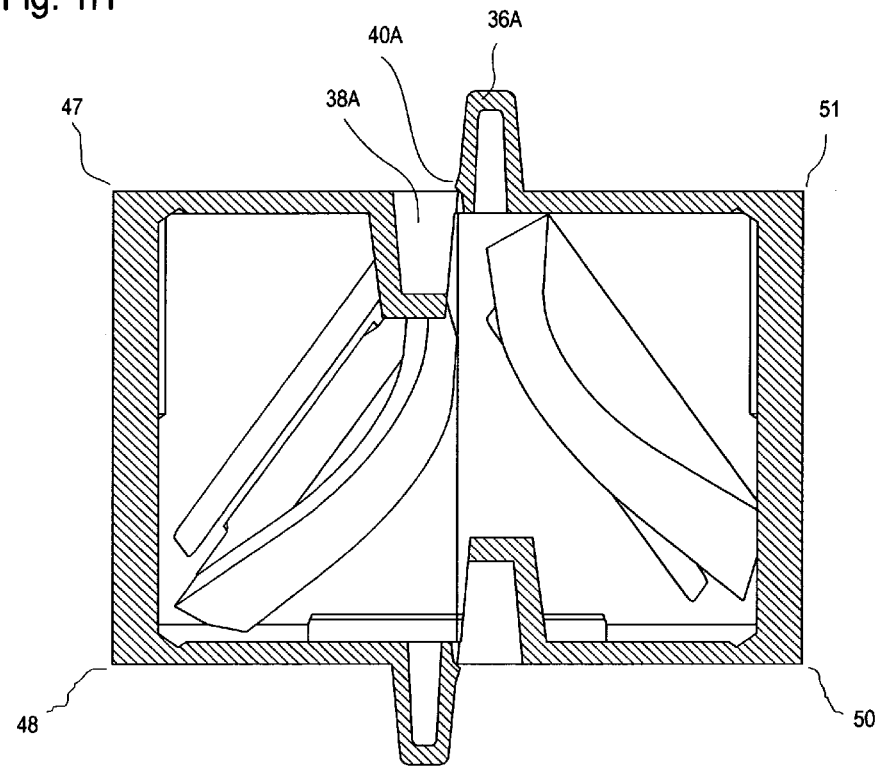
FIG. 1H is a cross-section showing details of my pattern cube's connectors.

The relationship between the contours of male fin 36A and female slot 38A can be better understood through FIG. 1H (cross-sectional view of FIG. 1E). FIG. 1H shows a cross-section of both male fin 36A and female slot 38A at their midpoints.

Figure 2A:
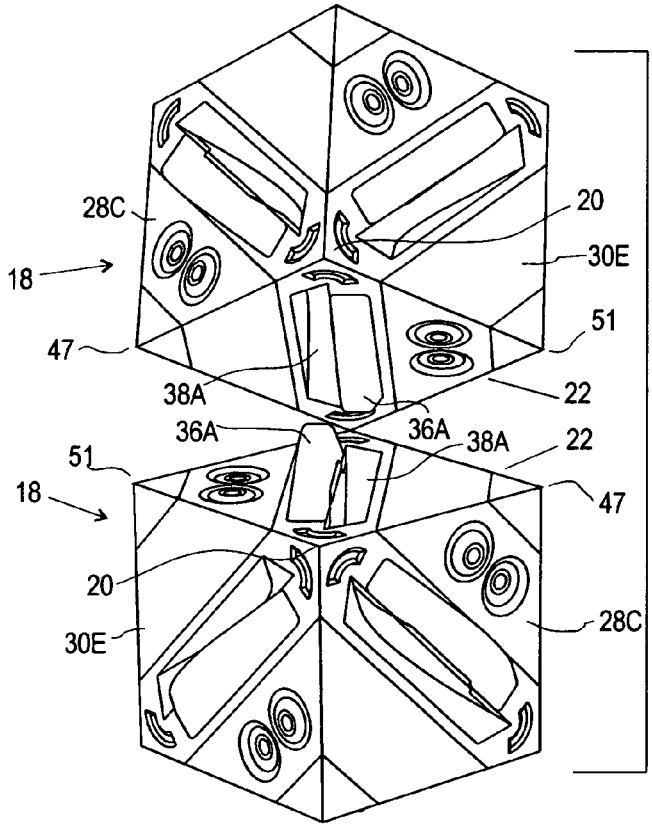
FIGS. 2A-2E illustrate the manners in which two of my pattern cubes can connect with one another.
Figure 2B:
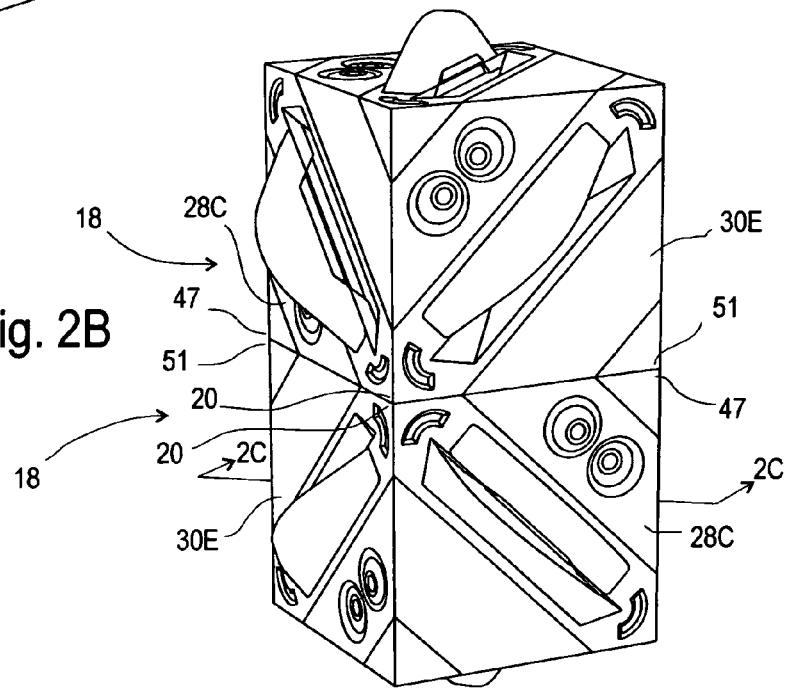
Figure 2C:
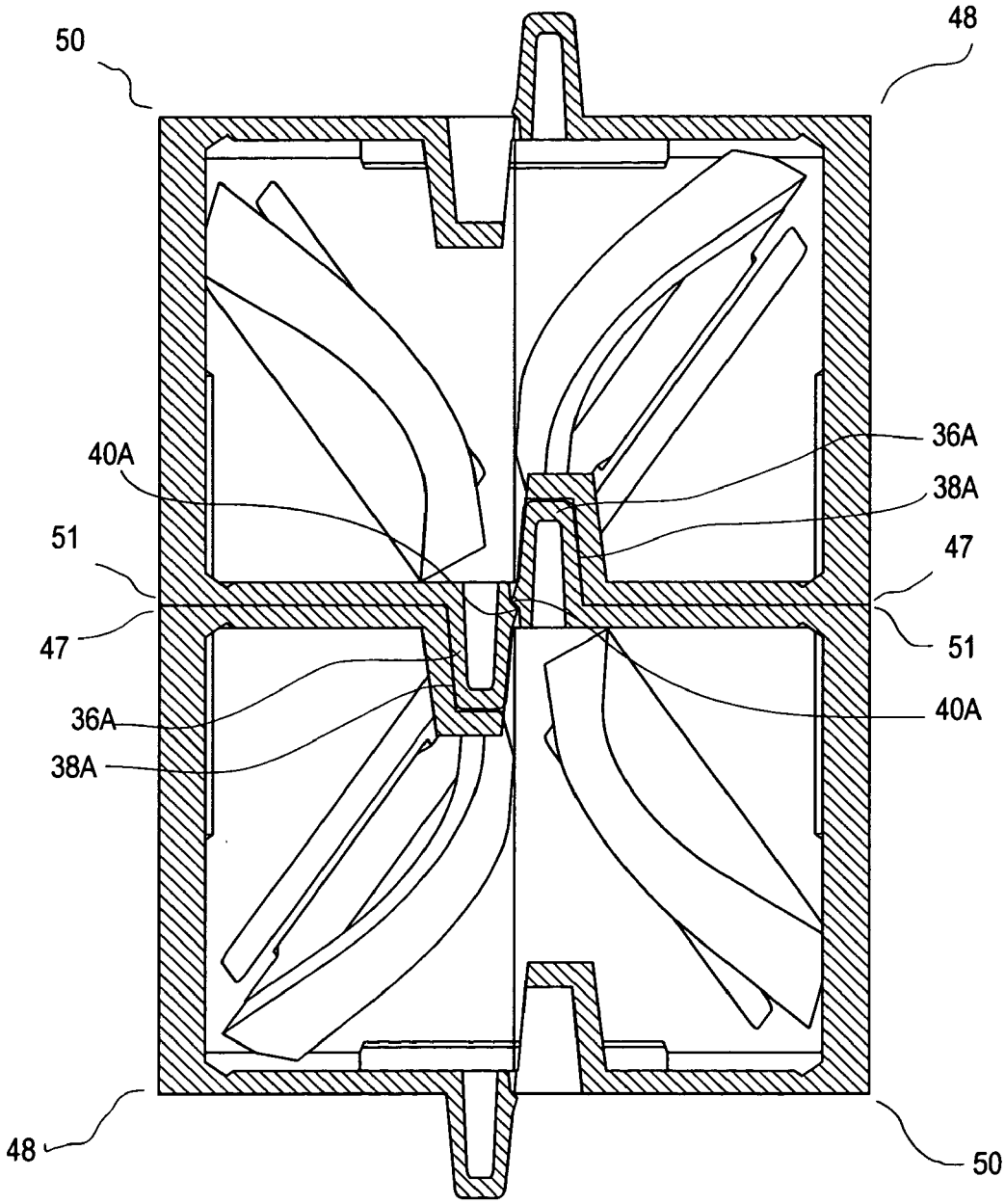

An even more complete picture of this relationship is shown in FIG. 2C, which shows cross-sectional views of two connected iterations of my pattern cube. The manner of cross-cutting is the same for both cube iterations and can be understood from FIG. 2B (perspective view). In FIGS. 2B and 2C, one iteration of my pattern cube is positioned so that it represents a 180 degree rotation of the other. In this configuration, it can be seen in FIG. 2C that the two pictured male fins 36A fit snugly into the two pictured female slots 38A.

FIG. 1A (side perspective) and FIG. 1D (side view) show a snap-connective member or lateral ridge 40A. Lateral ridge 40A forms a shelf extending from male fin 36A across diagonal 34. Although diagonal 34 cannot be seen in FIG. 1D, this figure does show outer corner 46, which is an endpoint of diagonal 34. If it could be portrayed in this view, diagonal 34 would be projecting directly out of the paper from outer corner 46. Thus, FIG. 1D can be used to understand the manner in which lateral ridge 40 projects across diagonal 34.

FIG. 1E (side view) can be used to understand the base angles 52 and 54 of male fin 36A. It can be seen in this figure that base angles 52 and 54 are equal, and, therefore, that male fin 36A is isosceles.

The perspective of FIG. 1E also illustrates the orientation in which components of this pattern cube would be injection molded. From this perspective, the path of mold pull would be vertical. In FIG. 1E, the surface of face 22, shown on edge, can be understood to form an acute, "predetermined" angle with this vertical path of mold pull. To facilitate straight-pull injection molding, base angles 52 and 54 must be less than or equal to this predetermined angle. This predetermined angle is approximately 35.26 degrees.

FIG. 1A (perspective view) shows two more features of my preferred embodiment. Two eyes 42AR and 42AL are situated in band 60, and two dimples 44AR and 44AL are situated near opposite ends of diagonal 34. [The suffixes R and L refer to the side of the face on which each eye and dimple is positioned, from the point of view of an observer staring face-to-face at face 22.]

Finally, it can be understood from FIG. 1A that face 22 has mirror symmetry. The mirror plane of that symmetry is perpendicular to diagonal 34 and passes through outer corners 47 and 51.

Assembly

FIG. 1F (exploded view) and FIG. 1G (side perspective view) show how my preferred embodiment is assembled from two injection-molded halves. FIG. 1F shows the interiors of each of these halves. Three interiorly hexagonal tubes 66 are attached to the interior of set 18. FIG. 1F also shows three cylindrical pins 68 attached to the interior of set 19. FIG. 1G shows how these halves are assembled to make a whole cube. Pins 68 insert into tubes 66 to create a permanent friction fit.

Summary

FIGS. 1B and 1C

In the previous section, the features of face 22 were described in detail. Now the features of the entire cube of six faces will be summarized in reference to face 22.

Face 22 is one member of the set 18 of three contiguous faces. This set 18 has third order rotational symmetry about its common corner 20. Therefore, each face 22, 24, and 26 of the set 18 is identical. Furthermore, the second set 19 of contiguous faces, comprising contiguous faces 23, 25, and 27 is an enantiomer (mirror image, but not identical) of set 18.

Although set 18 and set 19 are mirror images but not identical objects, each individual face 23, 25, and 27 is identical to each face 22, 24, and 26. It is the orientations of the faces in each set that lend the sets their non-identicality.

Operation—Preferred Embodiment

FIGS. 2A-2H

Connection Basics

My pattern cubes function as snap-together, pattern-creating building blocks. FIG. 2A (perspective view), shows two pattern cubes that are preparing to engage and snap together. In this case, the connecting faces are face 22 of each block. Both male fins 36A are on their way to insertion into their corresponding female slots 38A. FIG. 2B (perspective view) shows the same pattern cubes after engagement. FIG. 2C (cross-sectional view of FIG. 2B) provides an unobstructed view of male fins 36A and female slots 38A, as they are positioned after the two cubes have engaged. FIG. 2C shows that lateral ridges 40A are creating interference that will resist disengagement of the two cubes. It can also be inferred that lateral ridges 40A must have created interference upon engagement, and that a "snap" occurred as the blocks were forced past the point of interference.

Types of Connections

Two of my cubes may be snapped together in exactly three geometrically distinct configurations. One of these configurations was just described in the preceding paragraph. FIGS. 2A and 2B show this configuration, which occurs when a face from a set 18 abuts with a face from another set 18. In FIGS. 2A and 2B, this type of connection has occurred, as two faces 22 (of set 18) have abutted.

Figure 2D:
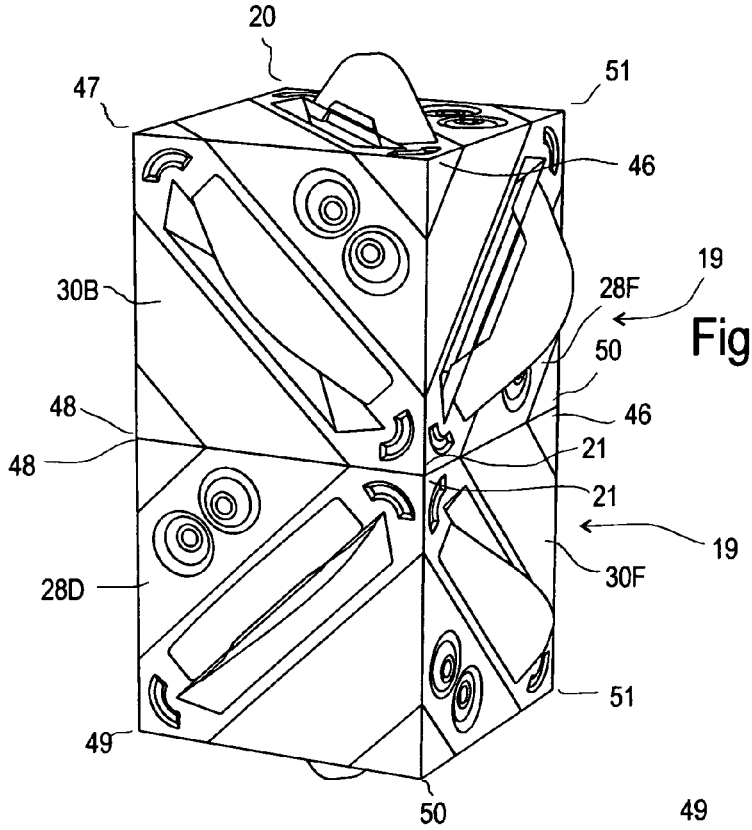
Figure 2E:
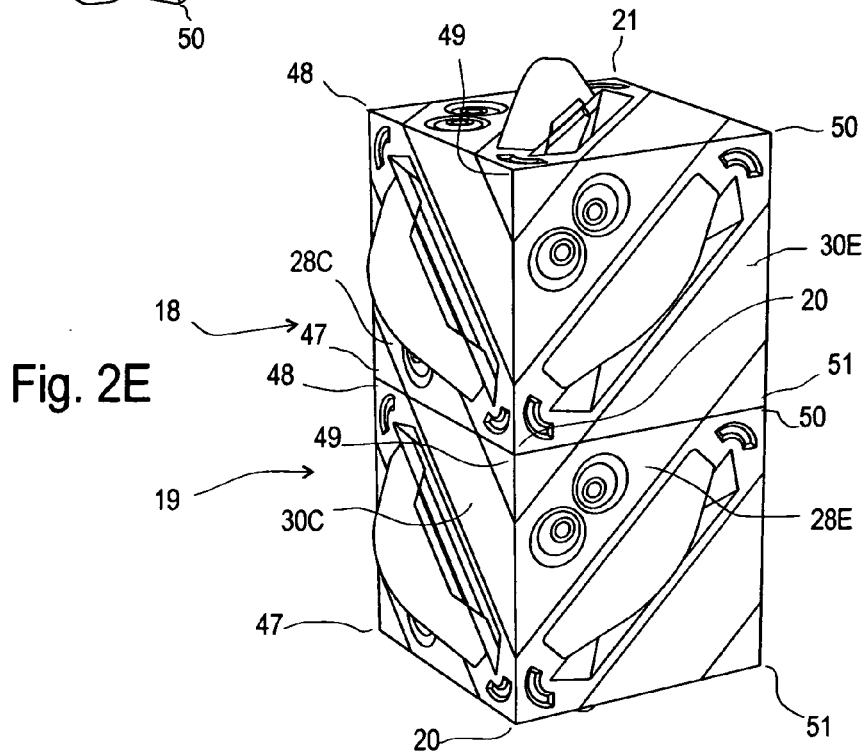

A second type of connection is shown if FIG. 2D (perspective view). This configuration results when the connectors of a face of a set 19 engage with the connectors of a face from another set 19. The specific faces that have connected in FIG. 13 are face 25 of the top cube and face 23 of the bottom cube (both of set 19). A third type of connection is shown in FIG. 2E (perspective view). This configuration results when connectors from a face of a set 18 engage with connectors from a face of a set 19. The specific faces that have connected in FIG. 2E are face 22 (a member of a set 18) of the top cube and face 25 (a member of a set 19) of the bottom cube.

By comparing FIGS. 2B and 2D, it can be seen that those two geometrically distinct configurations are enantiomers of one another. They are mirror images, but they are not identical.

Pattern Creation

FIGS. 2B, 2D, and 2E show that, whenever the connectors of two cubes engage, the bands of newly-adjacent faces meet with one another to form continuous banded patterns. For instance, in FIG. 2B, two pairs of bands 30E and 28C meet to form continuous bands that span the borders between cubes. In FIG. 2D, bands 30B and 28D meet to form a continuous band, as do bands 28F and 30F. In FIG. 2E, bands 30E and 28E form a continuous band, and so do bands 30B and 28D.

Figure 2F:
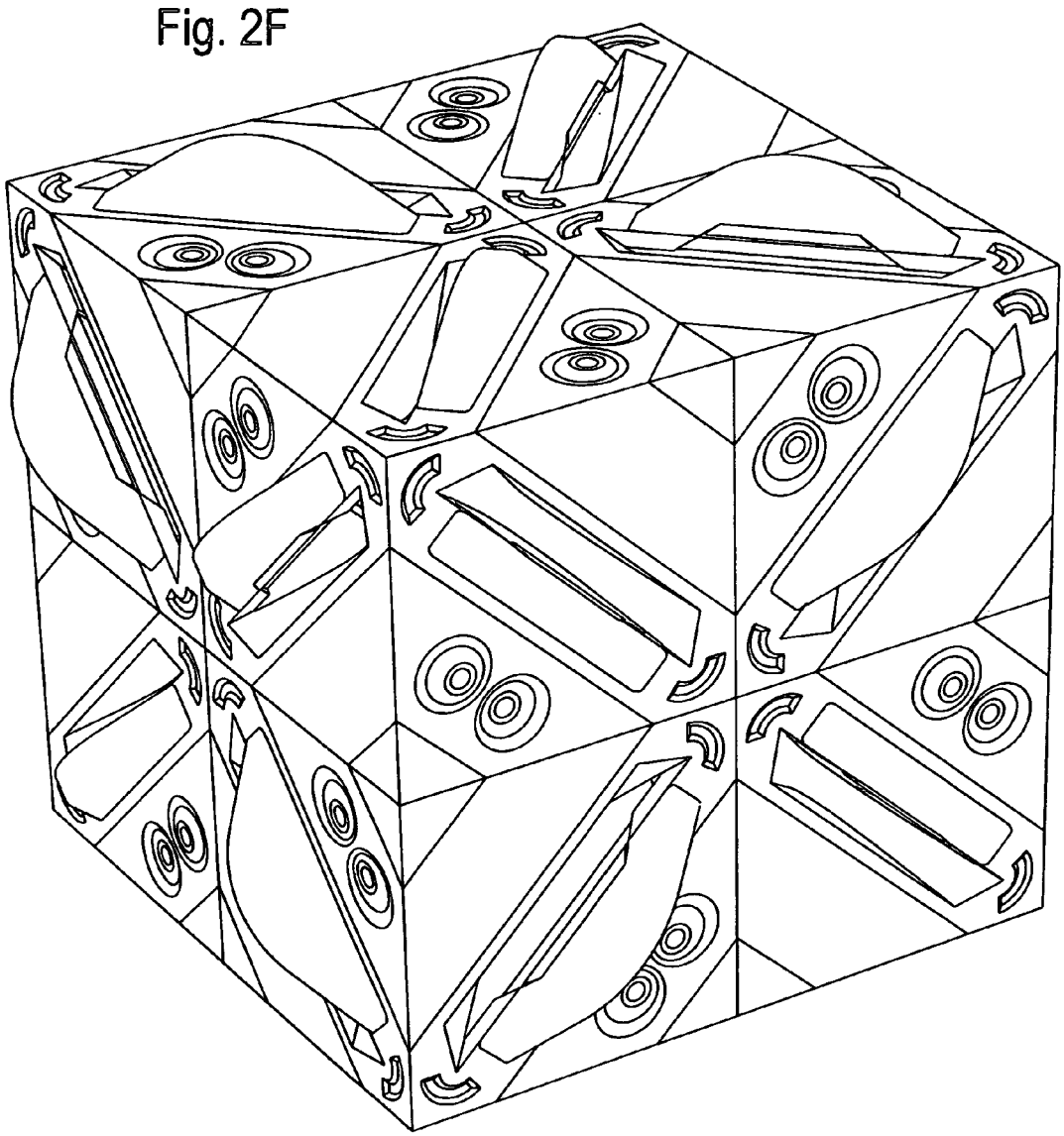
FIGS. 2F-2H show some examples of the banded patterns that emerge when a plurality of my cubes are connected together.
Figure 2G:
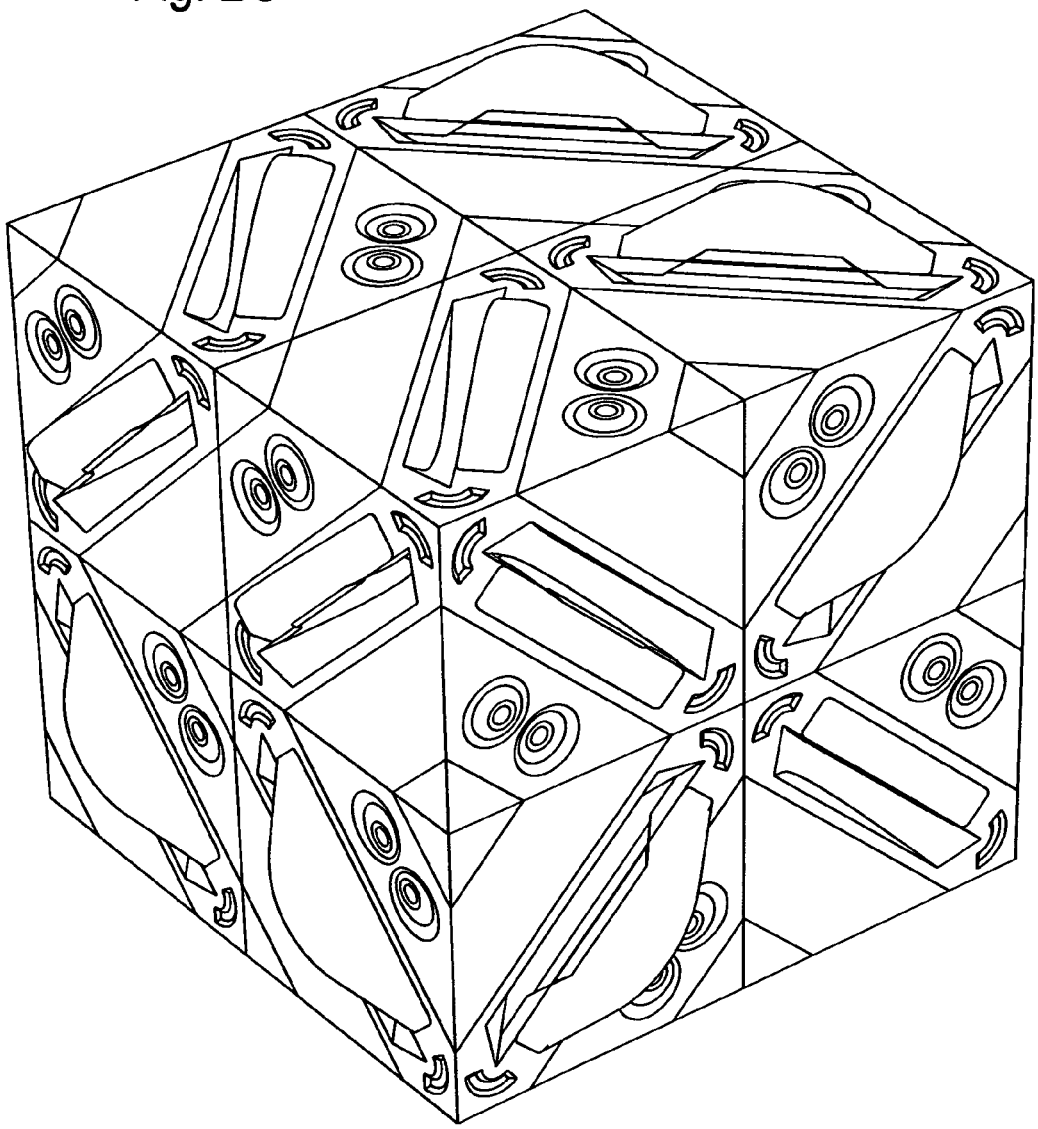
Figure 2H:
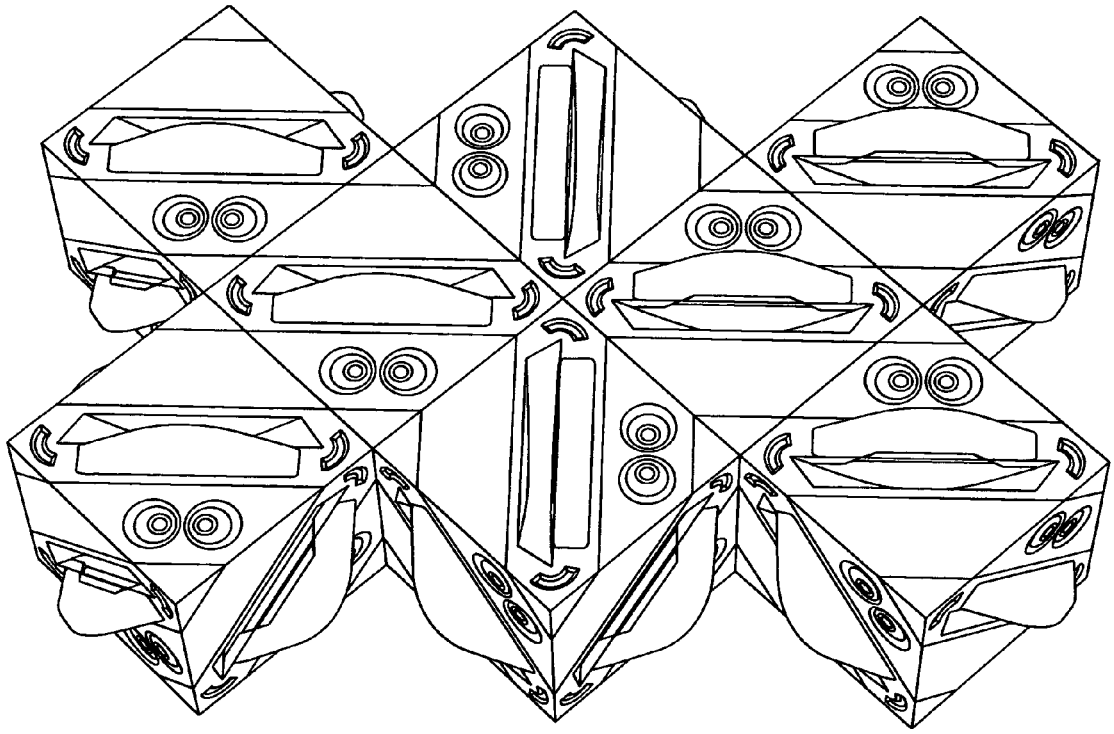

When multiple cubes are joined together, interesting banded patterns emerge. FIG. 2F (perspective view) shows an interesting banded pattern created with eight of my pattern cubes. All of the connections featured in this figure are connections between faces of sets 18. If the connections had been between faces of sets 19, the entire structure would have been a mirror image of this structure.

One aspect of my preferred embodiment that cannot be entirely understood from these figures is that the all bands 30A-F and 28A-F are painted black, while all other cube features are white. This contrast accentuates the banded patterns to an extent that is not clearly shown in FIGS. 2A-2H. The black color of the bands also causes the bands of each face to more realistically resemble masks. This causes the entire face to more realistically resemble that of a burglar or bandit.

Another important feature of my cubes' connections is that their bands may be made to form right angle or linear configurations. FIG. 2B, for example, shows band 30E and band 28C meeting at a right angle. In FIG. 2D, bands 30B and 28D also meet at a right angle. However, in FIG. 2E, bands 30E and 28E assume a linear configuration. This flexibility in band connections allows a user to create a variety of patterns. While FIG. 2F shows eight pattern cubes connected with all right angle connections, FIG. 2G (perspective view) shows how the banded patterns can be varied. This variation in band patterns was achieved by mixing linear and right-angle connection configurations within the same structure. It can also be seen that other, non-band elements of each face also create patterns, though they are not continuous across borders.

End Use

My pattern blocks may be an open-ended creative medium, an avenue for geometric exploration, or a puzzle. One particularly interesting puzzle involves creating structures of eight cubes with given numbers of "continuous" surface bands. The structure of cubes in FIG. 2H can serve to explain this. Although you cannot entirely tell from FIG. 2H, all of the individual bands on the surface of this structure form one continuous band that wraps around the structure. If you were to use a pen to trace one of the bands, and you were to continue tracing as each band lead to a band on the next block, you would continue your tracing back to where you began. In contrast, the structure of cubes in FIG. 2F has twelve separate continuous bands on its surface. A similar tracing process would produce twelve separate "squares" comprising four connected bands each.

A player can create an eight cube structure with exactly 1, 2, 3, 4, 5, 6, 7, 8, 9, or 12 continuous bands. Eight cube structures with ten or eleven continuous bands are impossible.

First Alternative Embodiment

Figure 3:
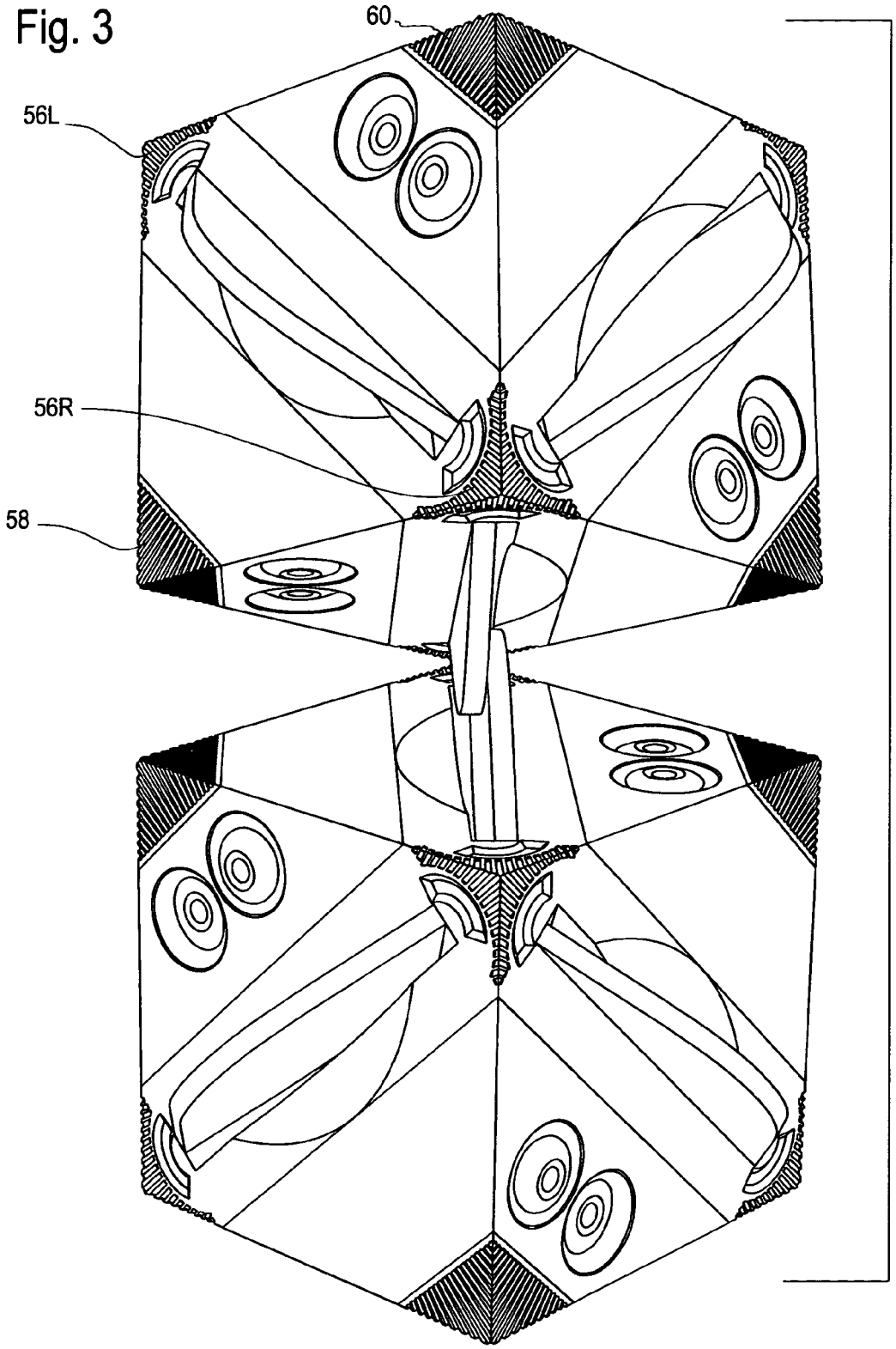
FIG. 3 shows an alternative embodiment of my pattern cubes featuring friction fit connectors.

FIG. 3 (perspective view) shows two iterations of a first alternative embodiment. This embodiment has simple friction fit connectors, rather than a snap-fit mechanism.

FIG. 3 also shows that this alternative embodiment features two cheek hair patches 56L and 56R, a chin hair patch 58, and a forehead hair patch 60.

Operation—First Alternative Embodiment

This alternative embodiment operates in exactly the same manner as the preferred embodiment, except for the fact that it utilizes a friction fit connection, rather than a snap-fit connection.

Second Alternative Embodiment

Figure 4:
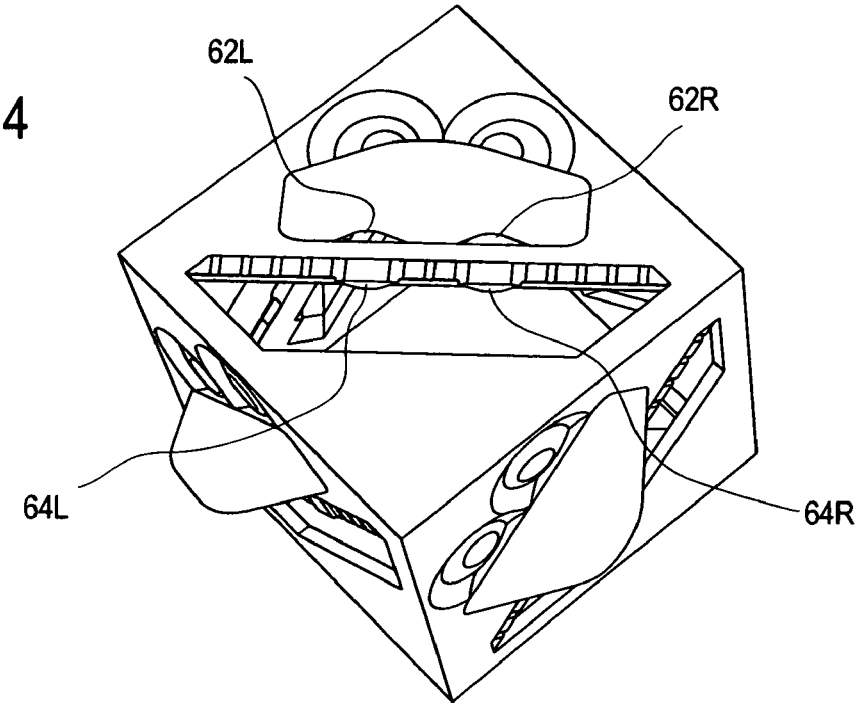
FIG. 4 shows an alternative embodiment which connects to other identical cubes by snapping its teeth into their nostrils.

FIG. 4 (perspective view) shows a second alternative embodiment with two nostrils 62L and 62R, and two large teeth 64L and 64R.

Operation—Second Alternative Embodiment

One of these second alternative embodiments can connect to another such cube by nose-biting. When the nose-biting connection is made, large teeth 64L and 64R (shown in FIG. 4) become seated in nostrils 62L and 62R. This occurs with a snap.

Third Alternative Embodiment

Figure 5:
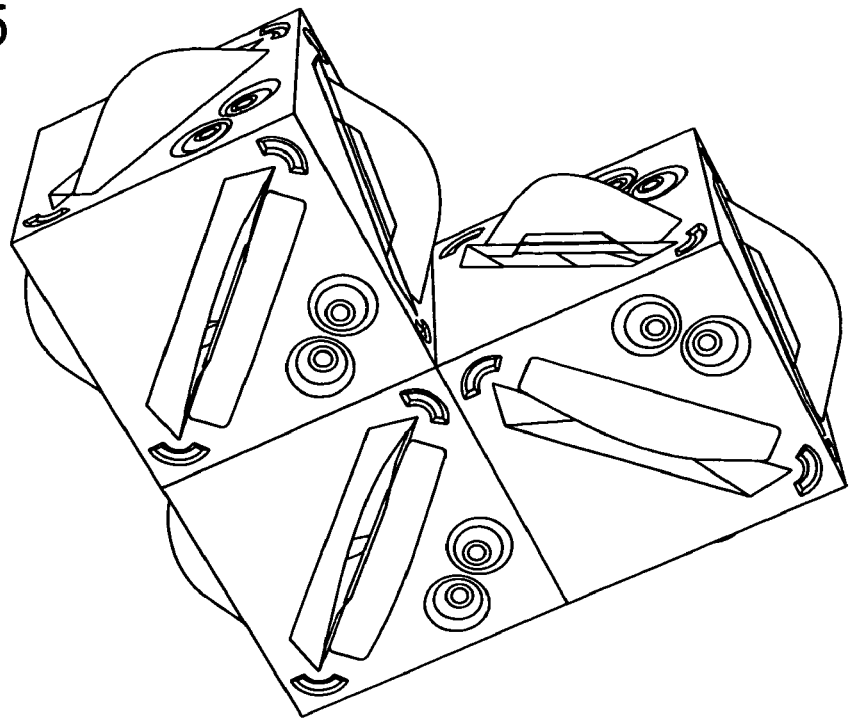
FIG. 5 shows an alternative embodiment that does not have bands.

FIG. 5 (perspective view) shows a third alternative embodiment, which is very similar to the preferred embodiment. The only difference is that it lacks the bands of the preferred embodiment.

Operation—Third Alternative Embodiment

As FIG. 5 shows, when multiple iterations of this third embodiment are connected, geometric patterns are formed by the facial features of the cubes. In FIG. 5, some noses are parallel, and some are at right angles to one another. This figure shows that, while a banded embodiment produces more accentuated patterns, an embodiment without bands still retains these patterns' basic elements.

Fourth Alternative Embodiment

Figure 6A:
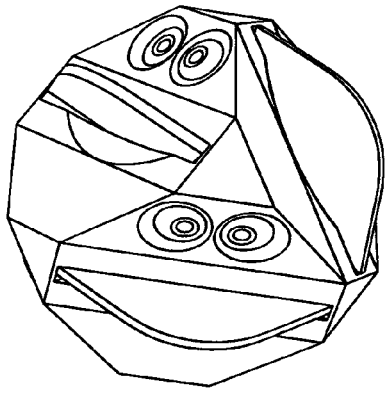
FIGS. 6A and 6B show an alternative embodiment whose corners have been truncated.
Figure 6B:
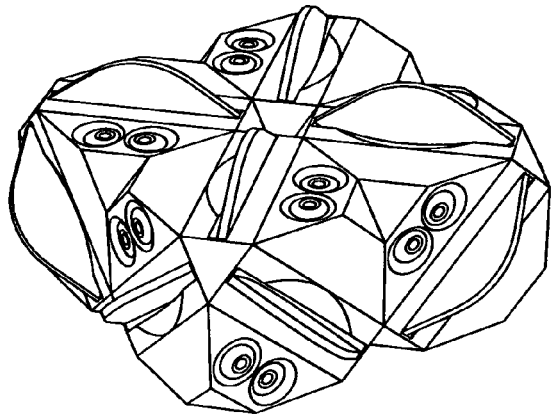

FIGS. 6A and 6B (perspective views) show a fourth alternative embodiment. This embodiment is similar to the first alternative embodiment (described above), but in this case the cube has been truncated. Each of its corners has been removed.

Operation—Fourth Alternative Embodiment

As FIG. 6A shows, truncation does not affect the function of these pattern cubes. Truncation does serve to "soften" the cube's corners.

Fifth Alternative Embodiment

Figure 7:
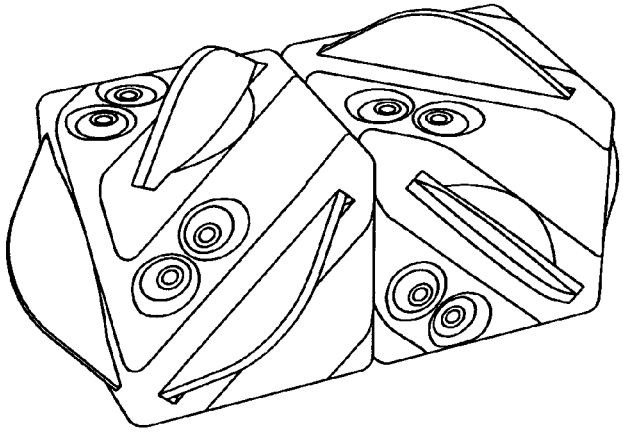
FIG. 7 shows an alternative embodiment with rounded edges and corners.

FIG. 7 (perspective view) shows two iterations of a fifth alternative embodiment, which features rounded corners and edges.

Operation—Fifth Alternative Embodiment

As FIG. 7 shows, multiple iterations of this fifth embodiment fit together in the same manner as other embodiments.

ADVANTAGES

From the description above, a number of advantages of my pattern cubes become evident:

(a) My pattern cubes can be snapped together, via any face, to tessellate (fill space) in three dimensions. This allows a great variety of open and closed structures to be built in any direction.

(b) My pattern cubes connect with a secure but releasable snap fit. Structures created with my pattern cubes can be moved—even tossed—while maintaining structural integrity.

(c) No matter which faces are connected, connecting my pattern cubes reveals interesting, continuous surface patterns. In a sense, there is no "wrong answer" when one builds with my cubes.

(d) My pattern cubes can be used as an intriguing and challenging puzzle. The two types of continuous patterns that emerge between cubes (right angle and linear) can be used judiciously to arrive at a "solution." One can, for example, build an eight cube structure with exactly one continuous band circumnavigating its surface.

(e) My pattern cubes are economical to manufacture. They may be injection molded as two pieces of plastic, using a straight pull mold. Those two pieces of plastic can be easily and permanently assembled with a press-fit.

(f) My pattern cubes are fun. Each of their identical faces looks like the face of a bandit. Individual cubes connect as two bandits bite one anothers' nose.

CONCLUSION, RAMIFICATIONS, AND SCOPE

While the above description contains many specificities, these should not be construed as limitations on the scope of the invention, but rather as an exemplification of one preferred embodiment thereof. Many other variations are possible. For example, Any edges of my cubes can be rounded or square.

Portions of my cubes may be cut away.

My cube's connectors can employ a variety of snap fit connectors.

My cubes can be made in any size.

My cubes can have more than one male connector and more than one female connector on each face.

My cubes' faces may include more or fewer elements of a visage, such as freckles, head and facial hair, nostrils, and eyebrows.

My cubes can be designed with no surface features other than a male fin and a female slot.

My cubes can be designed with a variety of non-connector surface features.

The non-connector surface features of the various surfaces of a single cube can vary. In other words, each surface can have different non-connector features. These differing features may include different band patterns, different visages, and any other type of differing graphics. A simple example of this might be a different number (1, 2, 3, 4, 5, or 6) on every surface.

My cubes can be created in a variety of shades and/or colors.

The two enantiomeric halves of my cubes may be different colors.

My cubes may be manufactured from a variety of materials.

My cubes may be made in various sizes.

The halves of my cubes may be assembled by different methods, such as sonic welding.

My cubes' non-visible features, such as their wall thicknesses and interior cavity features, may be designed in a variety of ways to facilitate manufacture and/or assembly.

Some portions of my cubes may be removed, as long as surface portions incorporating connectors or aligning indicia are retained. Such removal may cause my cubes to no longer resemble cubes, but the geometries of their connections will not be sacrificed.

My cubes may be assembled from any number of pieces of material.

Accordingly, the scope of the invention should be determined not by the embodiments illustrated, but by the appended claims and their legal equivalents.

I claim:

1. A pattern cube, comprising:

(a) a cube, comprising first and second sets of three contiguous faces (b) said first set of three contiguous faces, comprising a common corner, a first face, a second face, and a third face, and having substantial third order rotational symmetry about said common corner (c) said first face, comprising a first visible band, a second visible band, a first edge, an incorporeal diagonal, and a connective means (d) said first edge, being shared by said second face (e) said incorporeal diagonal, emanating from said common corner (f) said first visible band, beginning at the midpoint of said first edge and paralleling said incorporeal diagonal across said first face (g) said second visible band, being a mirror image of said first visible band across said incorporeal diagonal (h) said connective means, designed in such a manner that a first iteration of said first face can connect with a second iteration of said first face only if said first iteration of said first face represents a one hundred eighty degree rotation of said second iteration of said first face about said incorporeal diagonal (i) said second set of three contiguous faces, being a mirror image of said first set of three contiguous faces whereby, when a plurality of said cubes are connected, face-to-face, their bands form a variety of continuous and tessellating patterns.

2. The pattern cube of claim 1 wherein said connective means comprises a male fin and a female slot, said male fin paralleling said incorporeal diagonal and being situated adjacent to said incorporeal diagonal and at the midpoint of said incorporeal diagonal, and said female slot approximating a one hundred eighty degree rotation of said male fin about said incorporeal diagonal.

3. The pattern cube of claim 2 wherein said male fin further comprises a snap-connective means, said snap-connective means comprising a lateral ridge, said lateral ridge paralleling and projecting across said incorporeal diagonal.

4. A nose-biting construction cube, comprising:

(a) a cube, said cube comprising a first set of three contiguous faces (b) said first set of three contiguous faces, comprising a common corner, a first face, a second face, and a third face, and having substantial third order rotational symmetry about said common corner (c) said first face, comprising an incorporeal diagonal, a fin-shaped nose, and a mouth slot, said mouth slot being a substantial inverse of said nose (d) said incorporeal diagonal, emanating from said common corner (e) said nose, paralleling and lying adjacent to said incorporeal diagonal and being situated at the midpoint of said incorporeal diagonal (f) said mouth, approximating a one hundred eighty degree rotation of said nose about said incorporeal diagonal (g) a second set of three contiguous faces, being a mirror image of said first set of three contiguous faces;

whereby one iteration of said cube can be mated and aligned with a second iteration of said cube by the mutual insertion of noses into mouth slots.

5. The nose-biting construction cube of claim 4 wherein said first face further comprises first band and a second band, said first band beginning at the midpoint of an edge adjacent to said common corner and paralleling said incorporeal diagonal across said first face, and said second band mirroring said first band across said incorporeal diagonal.

6. The nose-biting construction cube of claim 4 wherein said first face further comprises a snap-connective means, said snap-connective means comprising a lateral ridge, said ridge being located near the base of said nose, paralleling said incorporeal diagonal, and projecting across said incorporeal diagonal.

7. A pattern cube, comprising:

(a) a cube, said cube comprising a first set of three contiguous faces (b) said first set of three contiguous faces, comprising a common corner, a first face, a second face, and a third face, and having substantial third order rotational symmetry about said common corner (c) said first face, comprising a first diagonal, a second diagonal, and an added surface feature (d) said first diagonal, emanating from said common corner (e) said second diagonal, perpendicular to said first diagonal (f) said surface feature, having mirror symmetry about said second diagonal but not about said first diagonal (g) a second set of three contiguous faces, being an enantiomer of said first set of three contiguous faces;

whereby, when multiple iterations of said cube are abutted by aligning iterations of said surface feature, face-to-face, a variety of continuous, tessellating patterns appear.

8. The pattern cube of claim 7 wherein said surface feature extends to an edge of said first face.

9. The pattern cube of claim 7 wherein said first face comprises multiple surface features, each extending to an edge of said first face.

* * * * *